US007703308B2

(12) United States Patent
Nagelski

(10) Patent No.: US 7,703,308 B2
(45) **Date of Patent: *Apr. 27, 2010**

(54) DISPLAY HOOK ASSEMBLY HAVING A SECURE FREE END

(75) Inventor: Keith C. Nagelski, Huntersville, NC (US)

(73) Assignee: Invue Security Products Inc., Charlotte, NC (US)

( * ) Notice: Subject to any disclaimer, the term of this patent is extended or adjusted under 35 U.S.C. 154(b) by 55 days.

This patent is subject to a terminal disclaimer.

(21) Appl. No.: 11/968,946

(22) Filed: Jan. 3, 2008

(65) Prior Publication Data

US 2008/0209960 A1 Sep. 4, 2008

Related U.S. Application Data

(60) Provisional application No. 60/879,899, filed on Jan. 11, 2007.

(51) Int. Cl.
*E05B 65/00* (2006.01)

(52) U.S. Cl. ..... 70/57.1; 70/62; 70/276; 70/413; 211/7; 211/54.1; 211/57.1; 211/59.1; 248/551

(58) Field of Classification Search ..... 70/14, 70/32, 33, 34, 59–63, 57, 57.1, 276, 413; 211/7, 54.1, 57.1, 59.1; 248/551; 292/251.5
See application file for complete search history.

(56) References Cited

U.S. PATENT DOCUMENTS 1,022,980 A 4/1912 Stringer
1,856,239 A 5/1932 Buckley
2,384,208 A * 9/1945 William ..... 70/276
3,395,555 A * 8/1968 Hickman ..... 70/39
3,566,636 A * 3/1971 Rudolf et al ..... 70/276
3,656,328 A * 4/1972 Hughes ..... 70/276
3,657,907 A * 4/1972 Boving ..... 70/38 C
3,837,195 A 9/1974 Pelto
3,857,262 A * 12/1974 Sidiropoulos ..... 70/276
4,022,038 A 5/1977 Miller
4,127,996 A * 12/1978 Malminen et al. ..... 70/365
4,425,771 A * 1/1984 Beach et al. ..... 70/276
4,462,497 A 7/1984 Maule
5,600,977 A * 2/1997 Piron ..... 70/57.1

(Continued)

FOREIGN PATENT DOCUMENTS

DE 19843036 A1 3/2000

(Continued)

*Primary Examiner*—Lloyd A Gall
(74) *Attorney, Agent, or Firm*—Christopher C. Dremann, P.C.

(57) ABSTRACT

A securable system for displaying items of merchandise on a display board. The display system includes a lockable end assembly that engages the free end of at least one rod of a merchandise display therein. The end assembly is slidable along the rod between an unlocked position where items of merchandise may be removed therefrom and a locked position where items of merchandise cannot be removed therefrom. The end assembly is lockingly engaged with the rod by a locking mechanism that is linearly moveable within an interior chamber of the end assembly. The end assembly is provided with a specially shaped recess in its outer wall which is positioned perpendicular to the linear motion of the locking mechanism. A complementary dipole magnet key is inserted into the recess to unlock the locking mechanism.

18 Claims, 8 Drawing Sheets

U.S. PATENT DOCUMENTS

| | | | | |
|---|---|---|---|---|
| 5,676,258 | A | 10/1997 | Leyden et al. | |
| 5,689,978 | A * | 11/1997 | Eklof et al. | 70/62 |
| 6,957,555 | B1 * | 10/2005 | Nagel et al. | 70/57.1 |
| 7,178,678 | B2 * | 2/2007 | Mansfield et al. | 211/7 |
| 7,392,673 | B2 * | 7/2008 | Fawcett et al. | 70/14 |
| 2003/0098964 | A1 | 5/2003 | Lee et al. | |
| 2004/0026344 | A1 | 2/2004 | Sedon et al. | |
| 2005/0029205 | A1 | 2/2005 | Mansfield et al. | |
| 2006/0157431 | A1 | 7/2006 | Nagelski et al. | |
| 2007/0241069 | A1 * | 10/2007 | Nagelski | 211/57.1 |

FOREIGN PATENT DOCUMENTS

| | | | |
|---|---|---|---|
| FR | 2690421 | A3 | 10/1993 |
| GB | 2305212 | A | 4/1997 |

* cited by examiner

DISPLAY HOOK ASSEMBLY HAVING A SECURE FREE END

CROSS-REFERENCE TO RELATED CASES

This application is a standard utility application claiming priority from U.S. Provisional Application Ser. No. 60/879,899, filed Jan. 11, 2007, the entire disclosure of which is incorporated herein by reference.

BACKGROUND OF THE INVENTION

1. Technical Field

This invention generally relates to merchandise display hooks that are attached to a display board or a wire display rack. More particularly, the present invention relates to display hooks that prevent the rapid removal of items of merchandise therefrom. Specifically, the invention relates to a security device for locking a merchandise display to prevent unauthorized removal of items of merchandise displayed thereon and to a system incorporating the same.

2. Background Information

Items of merchandise are commonly displayed for sale on long protruding rods supported from a peg board or slat board. These protruding rods are commonly referred to in the art as peg board hooks or slat board hooks. Similar rods may also protrude from a wire display rack for the same purpose. Usually, the items of merchandise are of a smaller range, such as batteries or small tools or other similar components. Such merchandise is an easy target for shoplifters because they can rapidly remove all of the items from a display and remove the merchandise from the store without being detected. Sometimes, the entire display with all the merchandise being displayed thereon is swept from the peg boards by the thieves.

Several devices have been proposed in the prior art for securely displaying items of merchandise thereon. U.S. Pat. No. 1,022,980, issued to Stringer discloses a suspendable rod that includes a lock for securing the same and preventing theft of the articles suspended therefrom. A first end of the rod is provided with a locking chain and the opposite end of the chain is securely connected to a lug formed on the body of a lock. The lock is locked and unlocked using a key that is turned in the lock to engage and disengage the same.

U.S. Pat. No. 1,856,239 issued to Buckley, shows a display system that includes two rods, that are both fixed in a base plate at one end. The opposite end of the upper rod is provided with a latch mechanism that includes downwardly extending legs that engage the sides of the lower rod. The legs are pivotally attached to the latch mechanism and are pivoted out of the way to allow articles to be positioned on the lower rod. The latch is released and swings back into place through the action of gravity. This display system is not locked to prevent theft. It is simply latched to stop articles from sliding off the rod.

U.S. Pat. No. 4,462,497 to Maule, discloses a display stand that includes an elongated upright that is secured to a vertical surface with screws. Two parallel rods are connected at their first ends to the support and extend outwardly away therefrom. A cross-member extends between the second ends of the two rods and is pivotally connected to the second end of the first rod. The cross-member is received into a slot in the free end of the second rod. A lock is slipped over the free end of the second rod and a key is required to lock the cross-member in place. The lock is a key-activated tumbler type lock and the key has to be used to both lock and unlock the device. The system is also vulnerable to thieves who are capable of picking conventional tumbler type locks.

U.S. Pat. No. 5,676,258, issued to Leyden et al, discloses a display system that has a Z-shaped plate at a first end to secure the system to a wall surface. The legs of the Z-shaped plate are positioned so as to clamp the wall surface between them. A display rod extends outwardly from the Z-shaped plate and terminates in a tip. A portion of the rod rearwardly of the tip is of a reduced diameter relative to the rest of the rod. A lock is press fitted onto the tip to prevent items of merchandise displayed thereon from being removed. The lock includes a pair of opposing walls having aligned bores therein. The first wall has a bore that is sized to closely receive the rod therethrough. The second wall has a bore of a smaller diameter which is sized to receive a portion of the tip therethrough. The lock includes a tumbler that is activated by a key to manipulate a catch into a position where it engages the reduced diameter portion of the rod. An undercut on the rod cooperates with the catch to prevent removal of the lock from the rod. When an item of merchandise is to be removed from the display, the key has to be introduced into the lock in order to manipulate the catch out of engagement with the rod. Once this is accomplished, the lock may be disengaged from the rod and the item of merchandise may be removed. Consequently, this system requires the use of a key to both lock and unlock the device. The system is also vulnerable to thieves who are capable of picking tumbler type locks.

U.S. Publication No. 2006/0157431, to Nagelski et al, and assigned to the present assignee, discloses a lock mechanism for a display rod that secures merchandise thereon and includes a special magnetic key for unlocking the same. The security device includes a lock with a magnetically attractable plunger housed in a chamber therein. The plunger moves linearly within the chamber between a locked position and an unlocked position. When the plunger is in the locked position it engages the display rod and prevents merchandise from being removed therefrom. When the plunger is in the unlocked position it does not engage the display rod and merchandise may therefore be removed from the rod. While the chamber is proximate the exterior surface of the device, it's existence and position would not be evident from a simple external examination of the device. Similarly, because of the key comprises a magnet that is completely surrounded by a housing, a simple external examination of the key would not reveal that there is a magnet in its interior. Even if it was determined that a magnet was needed to unlock the device, the location of the locking mechanism would be difficult to determine without spending a considerable amount of time manipulating the device and a bar magnet. This time spent would make it more likely that the thief will be caught in the act. The specially designed magnetic key for use by authorized personnel is disclosed in the publication as having a locating tab that must be engaged in a positioning groove in the exterior surface of the security device. This correctly positions the magnet on the exterior surface of the device and adjacent the locking mechanism. If the locating tab is not engaged in the positioning groove, then the magnet will not be correctly positioned on the security device's exterior surface, the plunger will not move and the device will remain locked.

Therefore, it is desired in the art to provide a security device for a merchandise display system that prevents the rapid removal of items of merchandise from the display and for a display system that incorporates the same.

SUMMARY OF THE INVENTION

The device of the present invention is an end assembly for securing a free end of a rod of a merchandise display to prevent items of merchandise from being swept from the rod.

The end assembly is slidable along the rod between an unlocked position where items of merchandise may be individually removed therefrom and a locked position where items of merchandise cannot be removed therefrom. The end assembly is locked onto rod by a locking mechanism that is linearly moveable within an interior chamber of the end assembly. The end assembly defines a specially shaped recess in its outer wall that extends inwardly into the interior of the housing and perpendicularly to the linear motion of the locking mechanism. The recess receives a complementary shaped dipole magnet key therein to unlock the locking mechanism. When inserted into the shaped recess, the key exerts a strong magnetic force on the locking mechanism and linearly moves the same within the chamber from a locked position to an unlocked position, thereby releasing the rod. Removal of the key from the recess in the end assembly causes the spring-biased locking mechanism to revert back to its locked position. This system only requires the dipole magnet key for disengaging the end assembly to dispense items of merchandise from the rod. When the system is to be locked after the dispensing of an item of merchandise, the end assembly is simply pushed along the rod until a notch in the rod aligns with the spring-biased locking mechanism. At this point, the locking mechanism automatically locks the device thereby preventing further removal of items of merchandise from the display. As the locking mechanism is contained within the interior of the end assembly, it is not immediately accessible to would-be thieves. Furthermore, the complementary nature of the shaped recess and shaped dipole magnet key also hinders would-be thieves by making it more difficult to access the locking mechanism to disengage the same. The locking mechanism itself is insulated from immediate access by a magnet and is oriented in such a manner that the force field from a common bar magnet will not easily move the locking mechanism within the interior chamber of the device.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
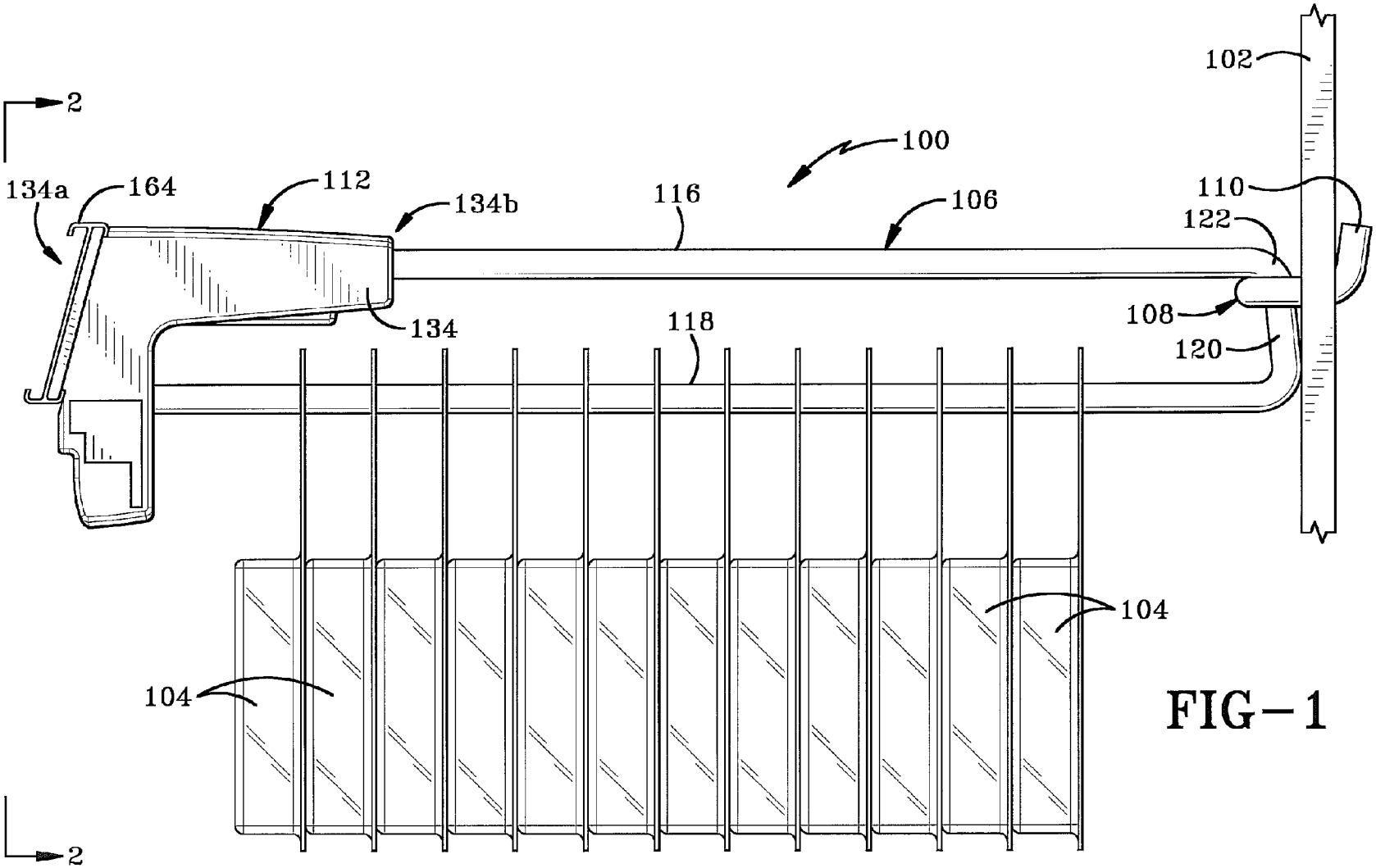
FIG. 1 is a side elevational view of a merchandise display of the present invention connected to a display board and having a plurality of items of merchandise hanging therefrom.
Figure 2:
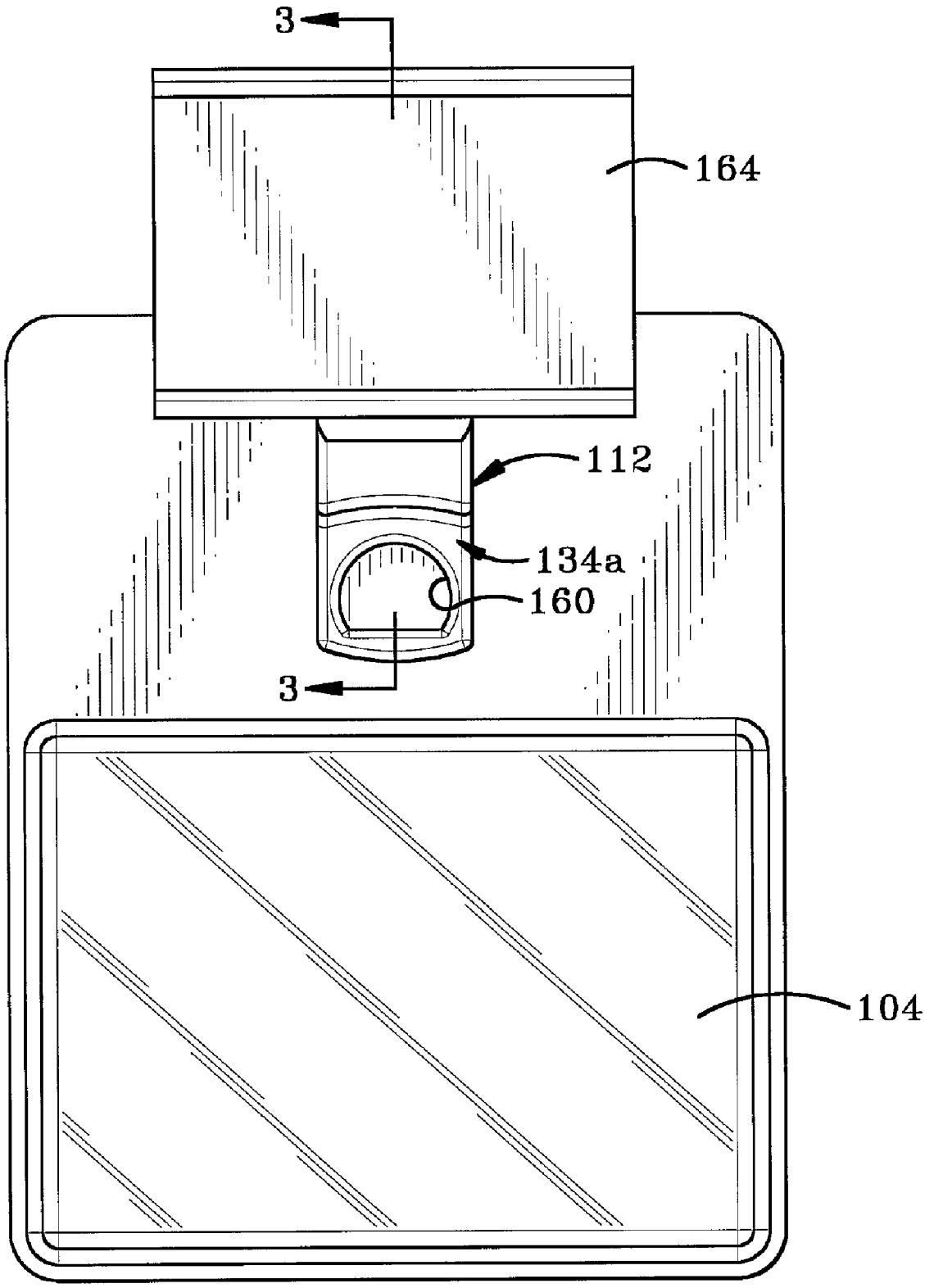
FIG. 2 is a front elevational view of the end assembly taken through line 2-2 of FIG. 1.

The merchandise display system of the present invention is indicated generally by the numeral 100, and is shown in FIGS. 1-8. Display system 100 is used with a display board 102 (peg board or slat board) to support merchandise 104 for display in a retail environment. Display system 100 comprises a rod assembly 106 and an end assembly 112. Rod assembly 106 includes substantially parallel first and second rods 116, 118 and a connecting rod 120 disposed therebetween. Rod assembly also includes an end 110 having one or more upwardly extending members that are receivable through holes in display board 102 to removably mount rod assembly 106 thereto in a cantilevered manner. Merchandise 104 is slidably engaged on second rod 118 and an end assembly 112 is provided to lockably secure merchandise 104 on second rod 118.

The present inventor is concurrently filing a U.S. patent application directed to a security device for lockably securing the rod assembly to the display board. This concurrently filed application is U.S. application Ser. No. 11/968,709 entitled "SECURITY DEVICE FOR ATTACHING A PEG HOOK TO A PEG SUPPORT". A second U.S. patent application directed to a magnetic key for unlocking both of end assembly 112 and the security device for attaching the rod assembly to a display board is also being filed concurrently herewith. This second application is U.S. application Ser. No. 11/968,680 entitled MAGNETIC KEY FOR USE WITH A SECURITY DEVICE. The entire disclosures of these two related applications are incorporated herein by reference. The present application is directed specifically to the end assembly 112 and to the merchandise security system incorporating the same.

Rod assembly 106 includes the upper rod 116 and lower rod 118 which are joined together by a connecting rod 120. End 110 extends outwardly from a connector 108 adjacent an inner end 122 of upper rod 116. All of these rods 116, 118, 120 and 108 are generally cylindrical in cross section. Upper rod 116 is shorter in length than lower rod 118 and terminates in a hooked free end 124 (FIG. 3) that is disposed inwardly of the free end 118*a* of lower rod 118. Free end 124 of upper rod 116 preferably is permanently secured within end assembly 112. The free end 118*a* of lower rod 118 extends outwardly beyond end 124 of upper rod 116 and terminates in a beveled and forward-extending tip 126. Lower rod 118 defines a downwardly facing notch 128 (FIG. 5) inwardly of tip 126. Notch 128 is bounded by side edges 130, 132.

Figure 3:
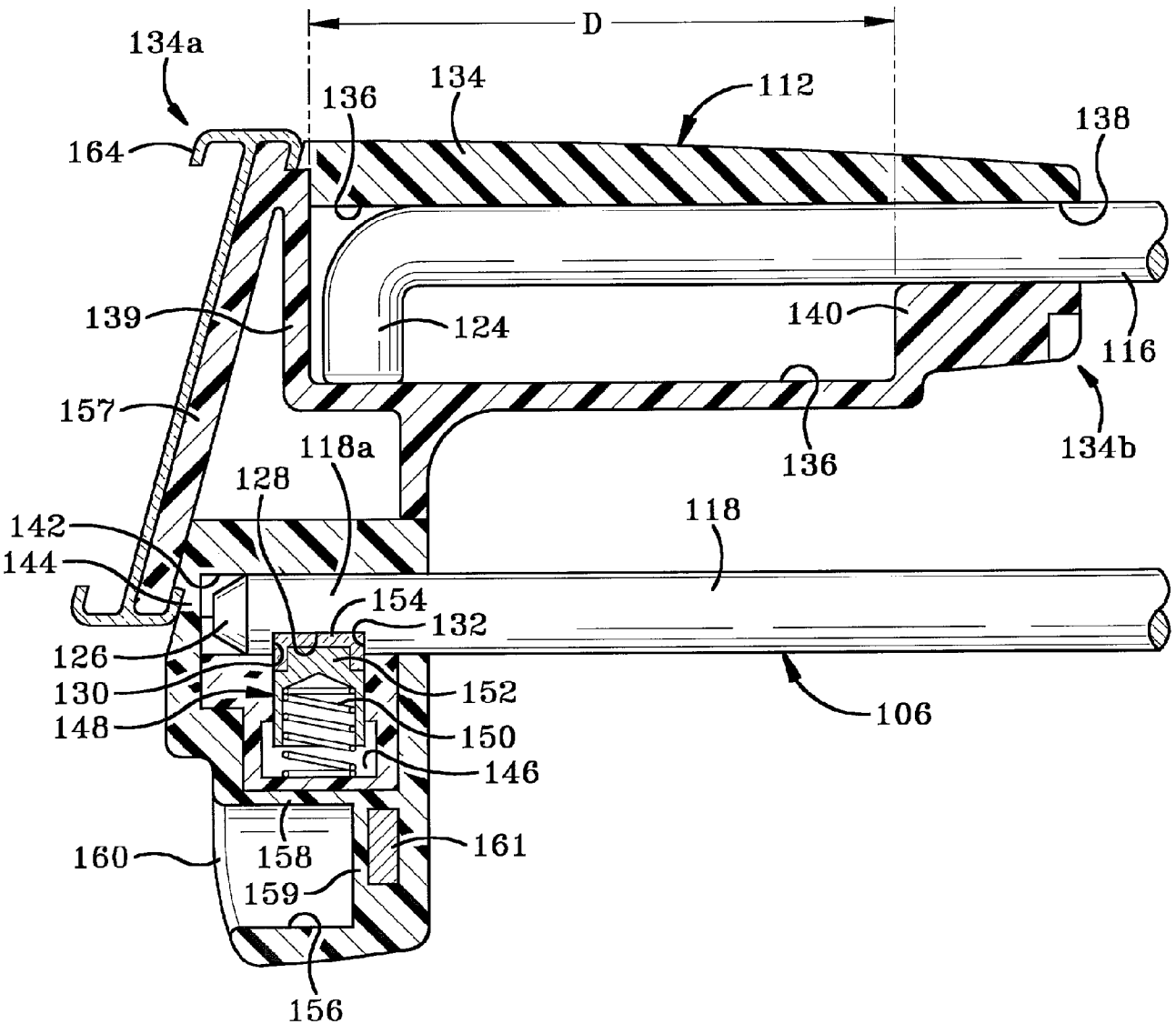
FIG. 3 is a cross-sectional side view of the end assembly taken through line 3-3 of FIG. 2.
Figure 4:
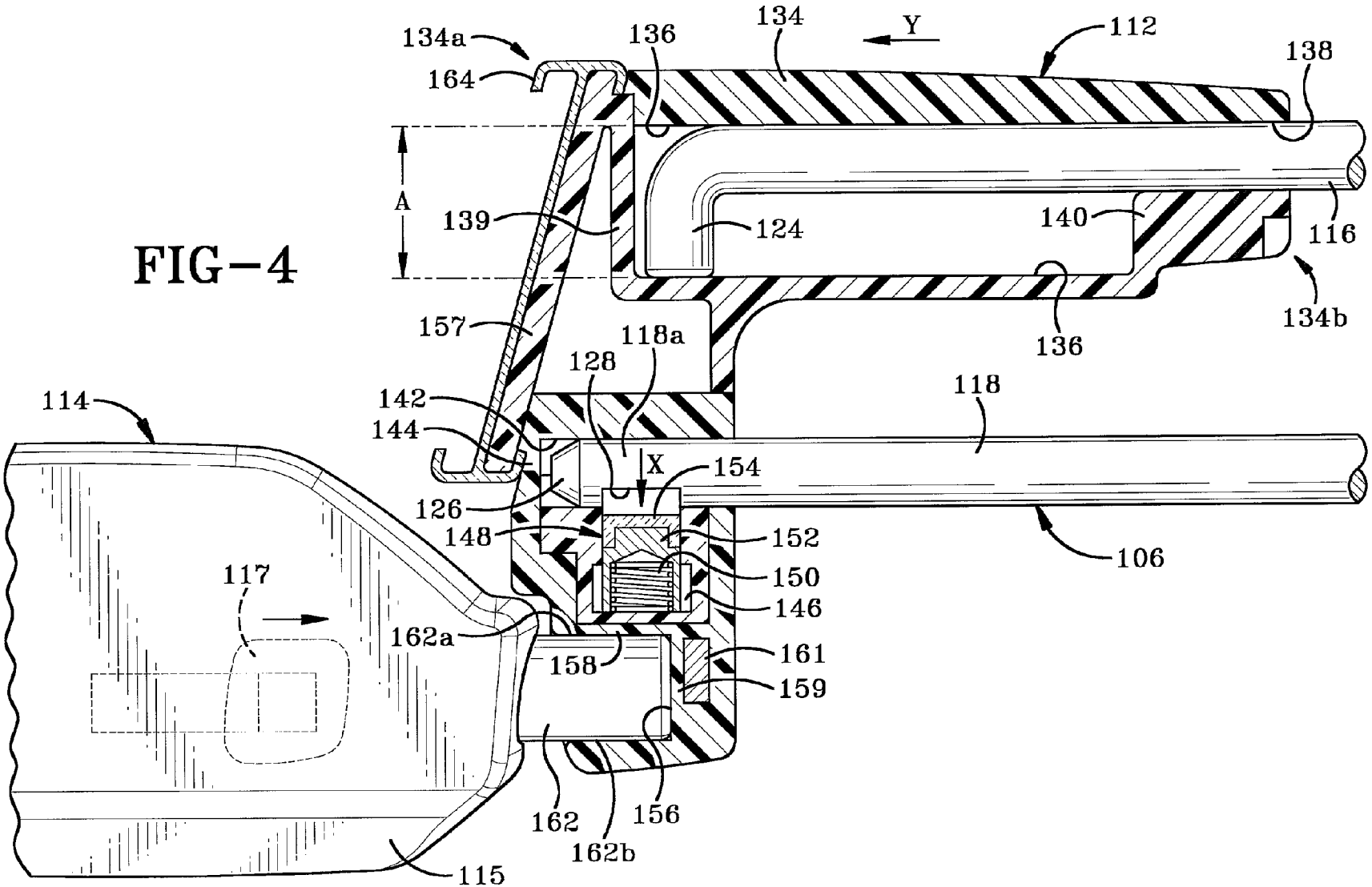
FIG. 4 is a cross-sectional side view of the end assembly being unlocked with a special key.
Figure 6:
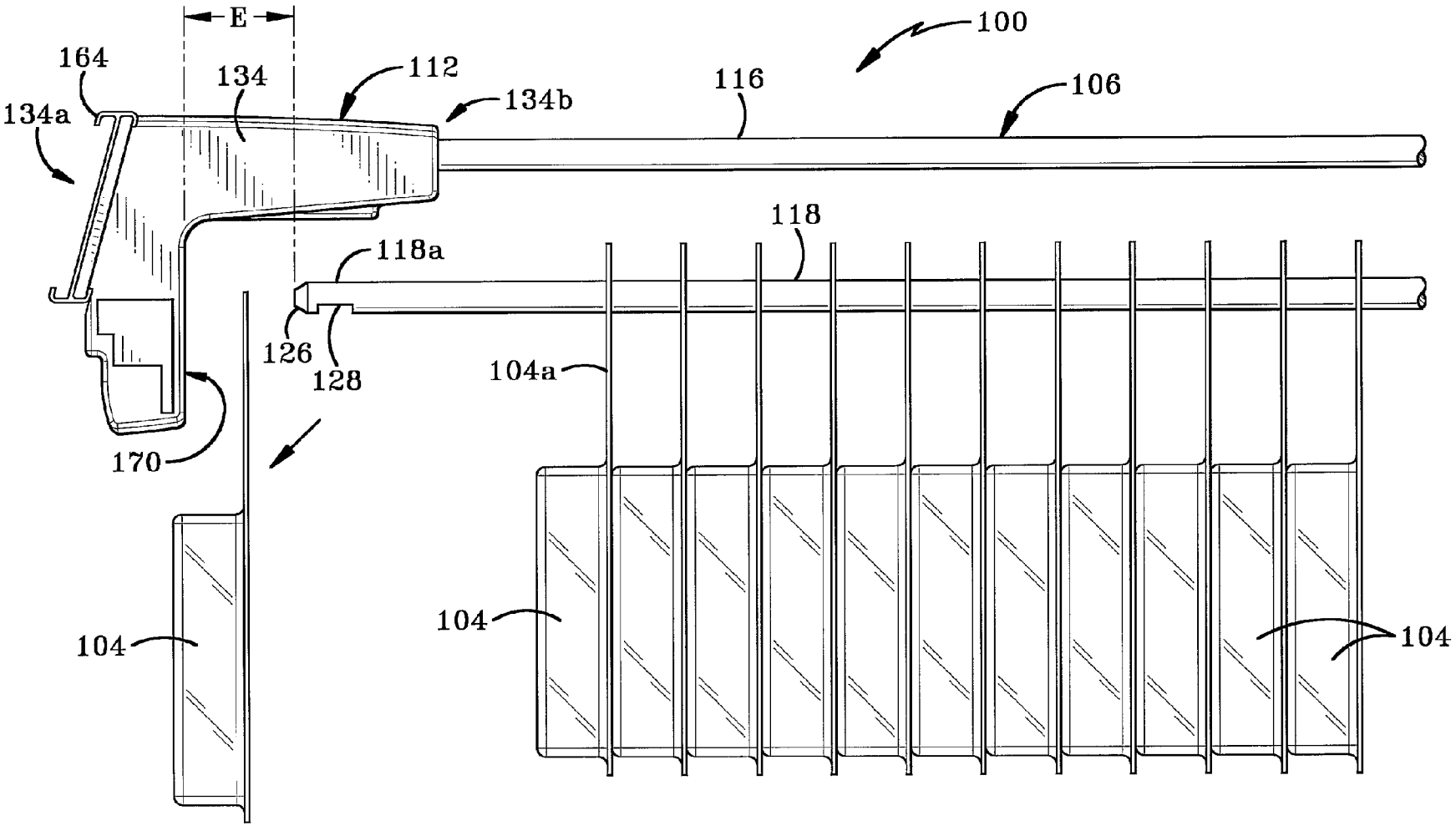
FIG. 6 is a side elevational view of the display showing removal of one of the items of merchandise therefrom.

In accordance with a specific feature of the present invention, end assembly 112 is provided to lockably secure free end 118*a* of lower rod 118 therein and to thereby prevent merchandise 104 from being removed from rod 118. End assembly 112 is movable along upper rod 116 between a locked position (FIGS. 1&3) and an unlocked position (FIGS. 4&6). When end assembly 112 is in the unlocked position, merchandise 104 can be removed from lower rod 118. When end assembly 112 is in the locked position, merchandise 104 cannot be removed therefrom.

Figure 5:
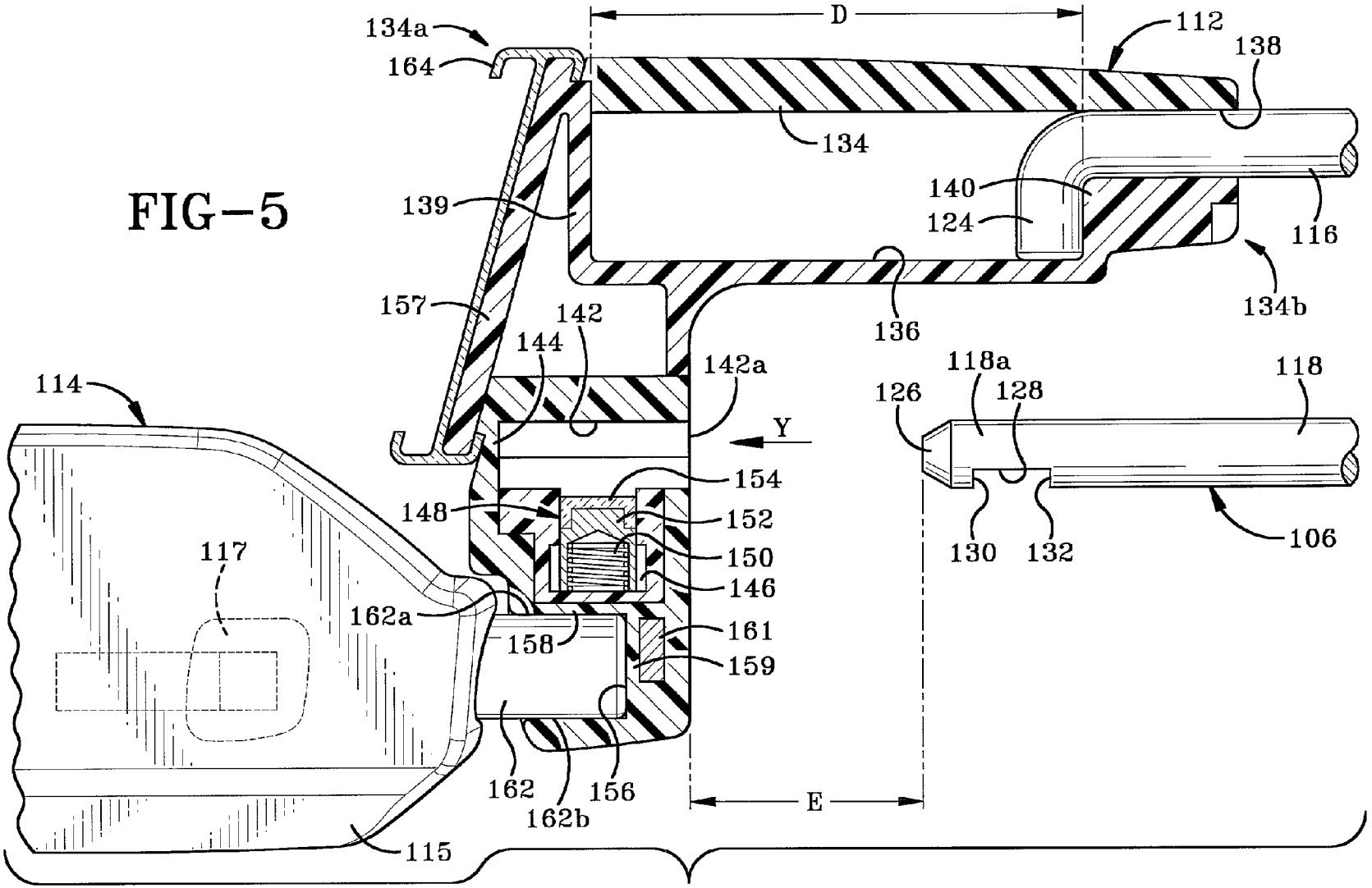
FIG. 5 is a cross-sectional side view of the end assembly with one of the rods of the rod assembly disengaged therefrom.

End assembly 112 comprises a housing 134 having a front 134*a* and a back 134*b*. Front 134*a* of end assembly 112 includes an upper wall 157 (FIG. 3) that has a display panel 164 affixed thereto. Panel 164 is provided for display of advertising or pricing information about the merchandise 104 retained on the display system 100. Panel 164 may also be used to indicate to the consumer whether end assembly 112 is in a locked position. Housing 134 defines a first interior chamber 136 that is accessible through a hole 138 in back 134*b* of housing 134. Upper rod 116 enters housing 134 through hole 138 and free end 124 of rod 116 is disposed within first chamber 136 and is permanently retained therein. Housing 134 is slidable along rod 116 between an unlocked and a locked position. When housing 134 is slidably moved along rod 116, free end 124 thereof travels within first chamber 136 between a first and a second position. FIG. 3 shows end assembly 112 in the locked position with free end 124 being disposed proximate an outer end wall 139 within housing 134. FIG. 5 shows end assembly 112 in the unlocked position with free end 124 disposed proximate an interior shoulder 140. Free end 124 preferably is hook-shaped and the leg of the hook is of a length substantially equal to the depth "A" (FIG. 4) of chamber 136. This comparative size between the leg and the depth of the chamber substantially prevents end assembly 112 from wobbling around on upper rod 116.

End assembly 112 further defines a first passageway 142 spaced a distance below and parallel to first chamber 136. Passageway 142 is complementary sized to receive the free end 118*a* of lower rod 118 therein. Passageway 142 originates in a hole in the rearmost wall of end assembly 112 and terminates in a wall 144 proximate front 134*a* of housing 134. The extent of travel of lower rod 118 through passageway 142 is limited by wall 144. End assembly 112 further defines a second interior chamber 146 that is in communication with passageway 142 and is disposed substantially at right angles thereto. In the preferred embodiment of the invention, second interior chamber 146 extends downwardly from passageway 142. When end assembly 112 is in a locked position on lower rod 118, end 126 of lower rod 118 is disposed proximate wall 144 and notch 128 in rod 118 is aligned with second chamber (FIG. 4).

In accordance with another specific feature of the present invention, a locking mechanism 148 is disposed within second interior chamber 146 of end assembly 112. Locking mechanism 148 is provided for locking end assembly 112 and rod assembly 106 together. Locking mechanism 148 includes a compression spring 150 seated in a shuttle assembly 152. Shuttle assembly 152 is complementary shaped and sized for reciprocal travel within second chamber 146 in a direction perpendicular to the longitudinal axis of the upper and lower rods 116, 118. A base portion 154 of shuttle assembly 152 is complementary shaped and sized to be received in notch 128 in lower rod 118 and to be retained between side edges 130, 132 thereof. Shuttle assembly 152 and base portion 154 thereof are biased by spring 150 to extend out of second chamber 146 and into passageway 142. When notch 128 is aligned with second chamber 146, spring 150 forces base portion 154 of shuttle assembly 152 into notch 128 and thereby locks lower rod 118 and end assembly 112 together. Shuttle assembly 152 preferably is manufactured from a metal that may be influenced by a magnetic force field. Base portion 154, on the other hand, is manufactured from an insulating material such as plastic to substantially prevent rod 118 from being attracted toward magnet 162.

As shown in FIG. 3, second interior chamber 146 is oriented so as to be a distance inwardly from and generally parallel to both the front and rear surfaces of end assembly 112. Furthermore, second interior chamber 146 is positioned a distance inwardly from both of the top surface and bottom surfaces of end assembly 112. The orientation of second interior chamber 146 and its distance away from being in close proximity to the exterior walls of the end assembly 112 aids in preventing the locking mechanism 148 from being unlocked by a common bar magnet being brought into contact with the exterior surface of the end assembly 112. The locking mechanism in end assembly 112 can only be unlocked by way of a specifically designed magnetic key 114, as will be disclosed below.

In accordance with another specific feature of the present invention, front 134*a* of housing has a lower portion in which there is defined a specifically shaped recess 156 for receiving magnetic key 114 therein for unlocking the locking mechanism 148. Recess 156 is substantially parallel to both the first chamber 136 and passageway 142. Recess 156 is also perpendicular to second chamber 146 and is generally at right angles to each of front and rear surfaces of end assembly 112. Recess 156 can only be entered via an opening 160 in the front surface of end assembly 112. This opening 160 has a cross-sectional shape that preferably is irregular and non-circular. Furthermore, opening 160 preferably has at least one straight side and is generally D-shaped. The magnetic key 114 that forms part of this security system comprises a housing 115 in which a dipole magnet is slidably mounted. The dipole magnet is extended from housing 115 by depressing a button 117 thereon to slide a portion thereof outwardly from the housing 115. The extended portion of the magnet forms a shaped protuberance 162 that is a complementary cross-sectional shape to that of recess 156. Recess 156 terminates in an inner end wall 159 and is separated from second chamber 148 by a horizontal interior wall 158. End wall 159 limits the ingress of protuberance 162 into end assembly 112. A metal plate 161 is enclosed within wall 159 adjacent recess 156. Plate 161 is formed from a metal that is magnetically attractable to assist in retaining key 114 in a locked configuration with end assembly 112.

It is, however, contemplated that end assembly 112 and key 114 will be designed for industry or store-specific use. As such, each industry or store will have a security system that includes a specifically shaped recess 156 in end assembly 112. End assembly 112 will only be able to be unlocked with the customized key 114 that has a complementary shaped cross-sectional profile to recess. In the preferred embodiment of the invention, recess 156 and the opening 160 thereto can be of any cross-sectional shape, and preferably are an irregular and non-circular shape. Furthermore, opening 160 preferably has at least one straight side and is generally D-shaped. Recess 156 could, however, be otherwise shaped, such as trapezoidal, hexagonal or triangular without departing from the spirit of the present invention. This arrangement substantially reduces the possibility of a would-be thief unlocking the end assembly 112 with any commonly available bar magnet as the magnet would not be able to be inserted into recess 156.

Furthermore, the dipole magnet used in key 114 preferably is manufactured from an alloy of neodymium, iron and boron (NdFeB) and, more specifically, is a sintered NdFeB magnet which has been nickel-plated. The dipole magnet is also specially manufactured to have a specific pole at an arcuate face 162*a* thereof and the opposite pole at a planar face 162*b* thereof. Arcuate face 162*a* is complementary to the rounded portion of the D-shaped recess 156 and planar face 162*b* is complementary to the flat portion of the D-shaped recess 156. Thus, the magnet may be manufactured so that the north pole is on arcuate face 162*a* and the south pole is on planar face 162*b* or vice versa. When protuberance 162 is inserted into recess 156, arcuate face 162*a* is brought into the proximity of shuttle assembly 152 and planar face 162*b* is remote from shuttle assembly 152. Thus, the magnetic field emanating from protuberance 162 is proximate the second chamber 146. In a common bar magnet, the magnetic force field extends outwardly away from the ends of the magnet and only a minimal force field is detected proximate the sides of the magnet. If a regular bar magnet could be inserted into recess 156, the sides of the bar magnet would be disposed proximate the wall separating recess 156 from second chamber 146. The magnetic lines of force experienced at the sides of the bar magnet would be insufficient to attract the locking mechanism 148 toward the bar magnet. The dipole magnet utilized in the present invention is manufactured specifically to ensure that the strongest area of the force field emanating therefrom is in the region proximate the wall between recess 156 and second chamber 146. Thus, the region of greatest magnetic attractability on the protuberance 162 is adjacent shuttle assembly 152. Furthermore, that force field is oriented such that the magnetically attractable metal of shuttle assembly 152 is drawn strongly toward protuberance 162. Furthermore, if for some reason shuttle assembly 152 itself includes a magnetic metal, then only the correct magnetic pole being brought into the vicinity of second chamber 146 will draw shuttle assembly 152 toward protuberance 162. The incorrect pole on key 114 would repel the shuttle assembly 152 and would keep lower rod 118 firmly secured within end assembly 112.

Referring to FIGS. 1-6, end assembly 112 is used in the following manner to securely lock the free end of rod assembly 106 and thereby prevent withdrawal of merchandise 104 from lower rod 118. FIG. 3 shows end assembly 112 and rod assembly 106 in a locked position. In this locked position, the free ends 124, 118*a* of upper and lower rods 116, 118 extend into housing 134 and are secured therein. Free end 124 of upper rod 116 is retained within chamber 136 and is disposed proximate an interior surface of end wall 139 of chamber 134. Free end 118*a* of lower rod 118 extends through passageway 142 and the tip 126 of rod 118 is positioned proximate wall 144. Locking mechanism 148 in end assembly 112 is in a locked position, with base portion 154 of shuttle assembly 152 engaged in notch 128 and being retained therein between side edges 130, 132 of lower rod 118. When locking mechanism 148 is in this locked position, compression spring 150 is fully expanded and base portion 154 of shuttle assembly 152 is spring biased to extend outwardly from second chamber 146, into passageway 142 and into engagement with lower rod 118. End assembly 112 cannot slide along upper and lower rods 116, 118 toward or away from display board 102. Thus, end assembly 112 is fixedly secured to rod assembly 106 and cannot be removed therefrom without the key 114 being used to unlock end assembly 112. Furthermore, because the free end 118*a* of lower rod 118 is locked within end assembly 112, merchandise 104 cannot be slidingly slipped off free end 118*a* of lower rod 118. Merchandise 104 is therefore locked onto the rod assembly 106 and cannot be removed therefrom.

When the consumer wishes to purchase one of the items of merchandise 104, end assembly 112 has to be unlocked and then slidingly moved away from display board 102 in the direction of arrow "Y" (FIG. 4) until free end 118*a* of lower rod 118 is spaced a distance away from end assembly 112. In order to unlock end assembly 112, key 114 has to be engaged therewith. This is done by engaging the button 117 on key 114 to slidingly extend a portion of the dipole magnet housed therein outwardly from housing 114. The extended and specially shaped protuberance 162 is inserted into opening 160 of recess 156 and is slid along recess 156 until an end thereof engages wall 159. As previously mentioned, protuberance 162 is oriented in recess 156 in such a way that arcuate face 162*a* is positioned proximate wall 158 that separates recess 156 and second chamber 146. The magnetic force field emanating from the dipole magnet attracts the metal portion of shuttle assembly 152 downwardly in the direction of arrow "X" (FIG. 4) within second interior chamber 146 toward protuberance 162. This downward movement compresses spring 150 between shuttle assembly 152 and wall 158 and causes base portion 154 to be withdrawn from notch 128 in lower rod 118. Once base portion 154 clears side edges 130, 132 of lower rod 118, locking mechanism 148 is in an unlocked position and end assembly 112 is free to slide along rod assembly 106 in the direction of arrow "Y" (FIG.4).

At the same time, the magnetic field from protuberance 162 magnetically attracts metal plate 161 toward it. This attraction is of a sufficient intensity to keep key 114 engaged in end assembly 112 and to enable the user to easily use key 114 to slidingly move end assembly 112 along rod assembly 106. When end assembly 112 has been slidably moved along rod assembly 108 to an extent sufficient to cause free end 118*a* of lower rod 118 to exit passageway 142, then items of merchandise 104 can be slid off rod 118. This will, however, cause shuttle assembly 152 to slide upwardly in the opposite direction to arrow "X" and cause it to obstruct passageway 142. Key 114 would have to be reintroduced into recess 156 in order to remove this obstruction. Alternatively, key 114 can be left engaged with recess 156 and, in this instance, end assembly 112 will remain in an unlocked position. It should be noted that when end assembly 112 is unlocked, the extent to which end assembly 112 may be slidingly moved along upper rod 116 is limited by the length "D" of chamber 136 (FIG. 3). As soon as end 124 of upper rod 116 abuts shoulder 140, the sliding movement along rod 116 is arrested. At this point, the distance "E" (FIG. 6) between tip 126 of lower rod 118 and inner wall 170 of housing 134 is fairly small. This distance "E" restricts the space available to slide merchandise 104 off lower rod 118. Consequently, even if the store assistant who unlocked the end assembly 112 leaves a potential thief unattended for a few minutes, the possibility that the person will be able to sweep a plurality of merchandise 104 off rod 118 at one time is substantially reduced.

When a store employee wishes to lock end assembly 112 to rod assembly 106, end assembly 112 is slidingly moved along rod assembly 106 toward display board 102. The tip 126 of lower rod 118 enters passageway 142. Movement in the direction opposite to arrow "Y" is continued until notch 128 in lower rod 118 is positioned over locking mechanism 148. Key 114 is removed from recess 156, if this has not already been done, and because notch 128 is positioned over shuttle assembly 152, spring 150 expands causing shuttle assembly 152 to slide upwardly toward lower rod 118. Base portion 154 of shuttle assembly 152 enters notch 128 and becomes wedged between side edges 130, 132. The locking mechanism is thereby moved automatically from an unlocked position to a locked position and, therefore, end assembly 112 is moved from an unlocked position to a locked position.

When merchandise 104 is to be loaded onto lower rod 118, end assembly 112 and locking mechanism 148 must be moved from a locked position to an unlocked position by key 114 as described above. Merchandise 104 is then individually loaded on lower rod 118. This is done by introducing the upper end 104*a* of the item 104 into the gap "E" between inner wall 170 of housing 134 and tip 126 of lower rod 118. Upper ends 104*a* are positioned so that a slot (not shown) therein is brought into the proximity of tip 126 and item 104 is moved toward display board 102 so that tip 126 passes through the slot. Item 104 is then slid along lower rod 118 in the direction of display board. Once all the merchandise 104 have been loaded onto lower rod 118, end assembly 112 is slid along rod 118 toward display board 102. End assembly 112 and locking mechanism 148 are then moved from the unlocked position to the locked position by sliding protuberance 162 of key 114 out of recess 156. The free end 118*a* of lower rod 118 is securely locked into end assembly 112 and merchandise 104 can no longer be removed from display system 100.

While the preferred embodiment of the invention shows that the free end 124 of upper rod 116 is permanently fixed within housing 134, it will be understood that free end 124 could instead be removable therefrom and be selectively secured or locked therein when needed in a manner similar to the locking mechanism applied to lower rod 118. Furthermore, it will be understood that passageway 142 in housing has been illustrated as terminating in wall 144 in housing. The passageway 142 could however extend completely through that housing 134 and end 118*a* of rod 118 could travel completely through passageway 142 and emerge on the other side of housing 134. The notch 128 can also be formed on an upper or side surface of lower rod 118 to interact with a locking mechanism provided in a complementary position within housing 134.

End assembly 112 is an improvement over the prior art for a number of reasons. Firstly, locking mechanism 148 is retained within the interior of the housing 134 and cannot be unlocked by application of a bar magnet to the external surface of the housing 134. Secondly the specifically designed shape and size of recess 156 in end assembly 112 substantially limits any attempted insertion of non-complementary shaped magnets into recess 156. Furthermore, the combination of the insulating base portion 154 of locking mechanism 148 and the thickness of interior wall 158 (which is also manufactured from an insulating material) provide a substantial barrier to preventing the magnetic force field of a non-dipolar magnet from influencing and unlocking the locking mechanism 148. If a would-be-thief managed to insert a non-dipole magnet into recess 156, it would be difficult for the magnetic force field of such a magnet to cause shuttle assembly 152 to move sufficiently out of notch 128 to unlock locking mechanism 148. Furthermore, the manufactured specificity of the polarity of the dipole magnet also reduces the possibility that any other magnet could be used to unlock the locking mechanism 148, even if it could be inserted into recess 156.

Figure 7:
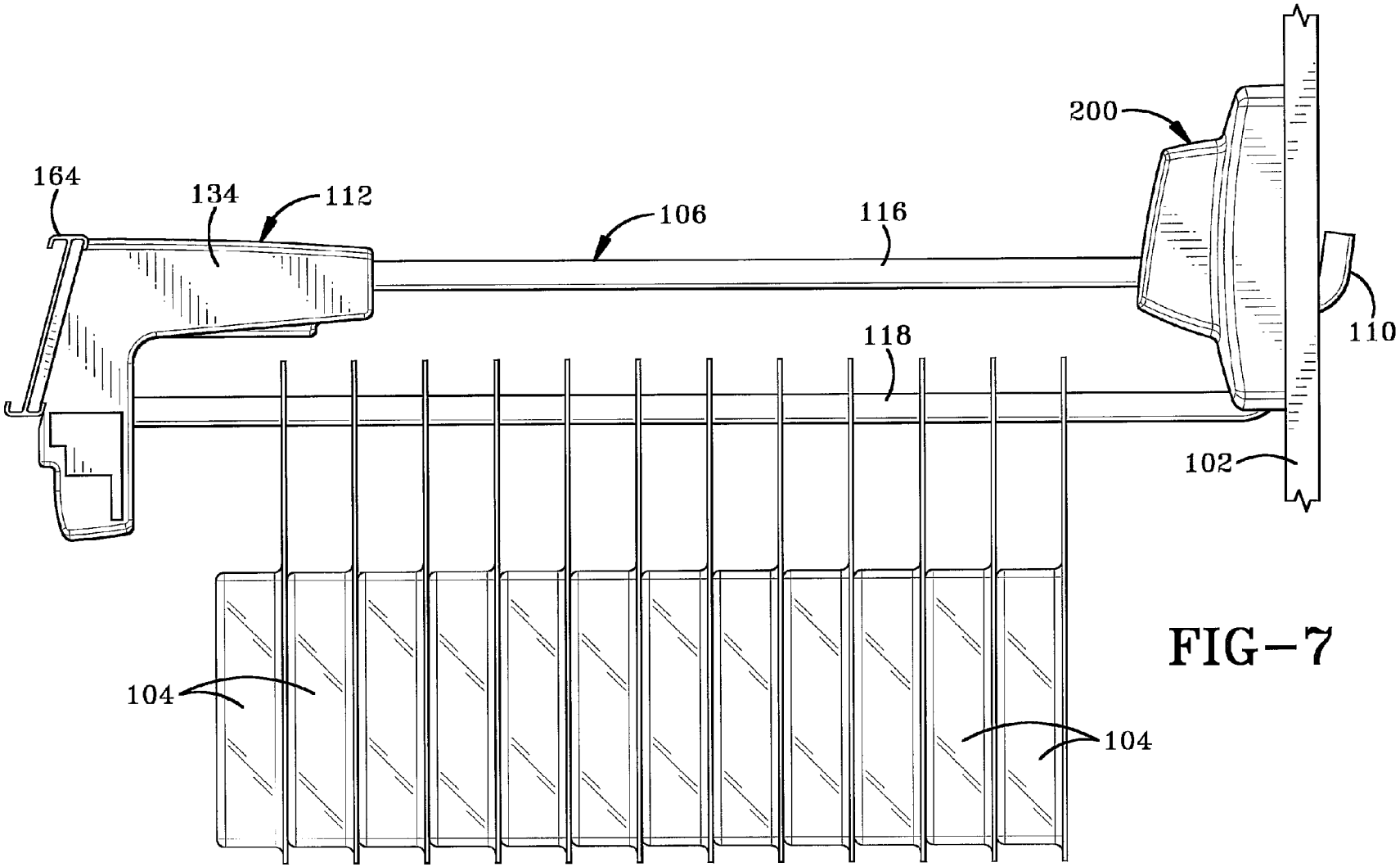
FIG. 7 is a side elevational view of a portion of the merchandise display system including the end assembly, rod assembly and base assembly.
Figure 8:
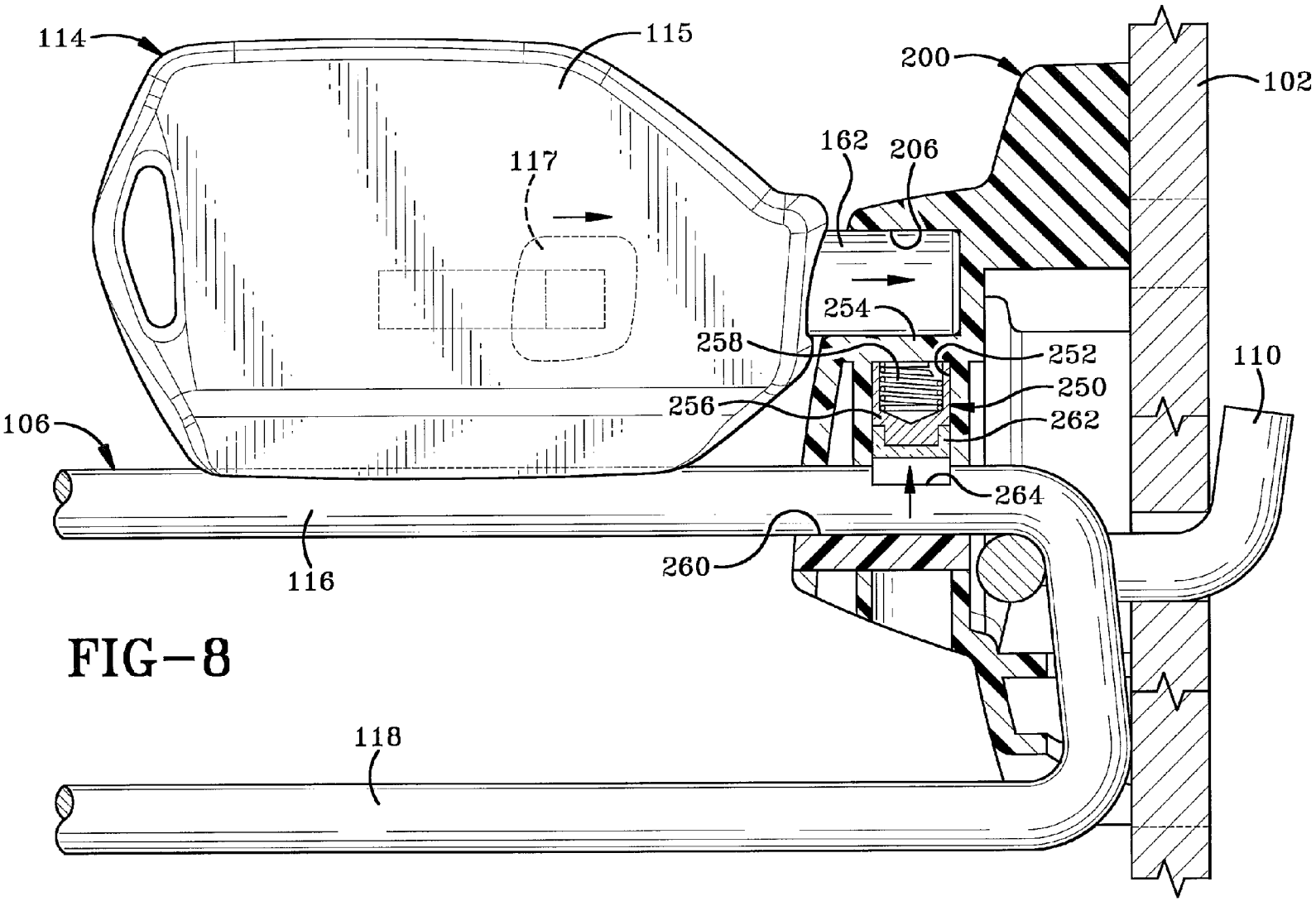
FIG. 8 is a cross-sectional side view of the key engaged with a base assembly to unlock the same.

As shown in FIGS. 7 and 8, the merchandise display system may also include a base assembly 200 that is provided to securely lock rod assembly 106 to display board 102. The key 114 is used to unlock both of base assembly 200 and end assembly 114 as the base assembly 200 includes a locking mechanism 250 that is contained within a chamber 252 within the interior of the device. Locking mechanism 250 is separated from direct contact with key 114 by a wall 254. As such, locking mechanism 250 is not directly accessible, such as by being close to the exterior surface of security device 200 or being engageable with a conventional key or switch. Locking mechanism 250 includes a metallic shuttle assembly 256 that is biased by a spring 258 into a passageway 260 through which the rod 116 passes. When locking mechanism 250 extends into passageway 260 it is received in a notch 264 in rod 116 and thereby locks rod 116 and base assembly 200 together. The metal in the locking mechanism 250 is attracted toward magnet 162 in order to move locking mechanism 250 from a locked position to an unlocked position in a manner that is substantially identical to that relating to end assembly 112. The base assembly 200 forms the basis of the first concurrently filed patent application by the present inventor that has been previously discussed herein.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A security device for locking a merchandise display rod having an upper rod and a lower rod to prevent unauthorized removal of items of merchandise displayed on the lower rod, said device comprising:

a housing defining a substantially horizontally oriented passageway having a length and adapted to receive the upper rod therein; said housing further defining an interior chamber disposed perpendicularly to said passageway and having a magnetically attractable locking member biased by a spring within the chamber towards a notch formed in the lower rod and linearly moveable against a biasing force of the spring within the chamber between a locked position where the locking member engages the notch in the lower rod and an unlocked position where the locking member does not engage the notch in the lower rod; and a recess formed in the housing and extending substantially parallel to the passageway and inwardly from an exterior surface thereof into the interior of the housing and terminating proximate the chamber; said recess being adapted to receive a dipole magnet therein for moving the locking member from the locked position to the unlocked position against the biasing force of the spring such that the housing is movable a distance substantially equal to the length of the passageway to thereby permit removal of the items of merchandise displayed on the lower rod.

2. The security device as defined in claim 1, wherein said recess extends perpendicularly with respect to the linear movement of the locking member.

3. The security device as defined in claim 1, wherein the recess is of an irregular cross-sectional shape and the dipole magnet is of a complementary cross-sectional shape.

4. The security device as defined in claim 1, wherein the recess is D-shaped in cross-section and is adapted to receive a complementary D-shaped dipole magnet therein.

5. The security device as defined in claim 4, wherein the D-shaped recess is defined by a substantially planar inner wall and an arcuate inner wall; and wherein the arcuate inner wall is proximate the chamber retaining the locking member therein and extends perpendicularly relative to the linear motion of the locking member.

6. A security system for locking a merchandise display rod having an upper rod and a lower rod to prevent unauthorized removal of items of merchandise displayed on the lower rod, said system comprising;

a security device including a housing defining a substantially horizontally oriented passageway having a length and adapted to receive the upper rod therein; said housing further defining an interior chamber disposed perpendicularly to said passageway and having a magnetically attractable locking member linearly moveable within the chamber between a locked position where the locking member engages a notch formed in the lower rod and an unlocked position where the locking member does not engage the notch formed in the lower rod;

a recess formed in the housing and extending substantially parallel to the passageway and inwardly from an exterior surface thereof into the interior of the housing and terminating proximate the chamber, the recess having a predetermined cross-sectional shape; and a dipole magnet sized and shaped to be inserted into the recess for moving the locking member from the locked position to the unlocked position.

7. The security system as defined in claim 6, wherein the recess is oriented perpendicularly with respect to the linear movement of the locking member.

8. The security system as defined in claim 6, wherein the dipole magnet and the recess are complementary in cross-sectional shape.

9. The security system as defined in claim 8, wherein the cross-sectional shape of both the dipole magnet and the recess is irregular.

10. The security system as defined in claim 8, wherein the cross-sectional shape of both of the dipole magnet and the recess includes at least one straight side.

11. The security system as defined in claim 8, wherein the dipole magnet and the recess are substantially D-shaped in cross-section.

12. The security system as defined in claim 11, wherein the dipole magnet has a planar face and an arcuate face; and wherein the dipole magnet comprises neodymium, iron and boron.

13. The security system as defined in claim 12, wherein the recess is oriented such that the arcuate face of the dipole magnet is brought into closer proximity to the locking member than is the planar face of the dipole magnet.

14. A securable merchandise system for displaying items of merchandise thereon; said system comprising;

a lower rod having a first end adapted to be positioned adjacent in a display board and having a second free end remote therefrom;

an upper rod disposed substantially parallel to the lower rod and spaced therefrom, the upper rod having a first end proximate the display board and a second hooked end;

a security device engageable with the free end of the lower rod and with the hooked end of the upper rod to prevent unauthorized removal of the displayed items of merchandise from the lower rod; said security device including a housing defining a substantially horizontally oriented first passageway for receiving the free end of the lower rod therein and a substantially horizontally oriented second passageway substantially parallel to the first passageway for receiving the hooked end of the upper rod therein; said housing further defining an interior chamber disposed perpendicularly to said first passageway and said second passageway; said housing comprising a magnetically attractable locking member linearly moveable within the chamber between a locked position where the locking member engages a notch formed in the lower rod and an unlocked position where the locking member does not engage the notch formed in the lower rod, the locking member biased within the chamber towards the lower rod;

a recess formed in the housing and extending substantially parallel to the first passageway and inwardly from an exterior surface of the housing and into the interior thereof, said recess terminating proximate the chamber; and a dipole magnet sized and shaped to be inserted into the recess for moving the locking member from the locked position to the unlocked position such that the housing is movable to withdraw the free end of the lower rod from the first passageway sufficiently to thereby permit the items of merchandise to be removed from the lower rod.

15. The merchandise system as defined in claim 14, wherein the recess is oriented perpendicularly with respect to the linear movement of the locking member.

16. The merchandise system as defined in claim 15, wherein the dipole magnet and the recess are complementary in cross-sectional shape and include at least one straight side.

17. The merchandise system as defined in claim 16, wherein the dipole magnet and the recess are generally D-shaped in cross-section and have a planar face and an arcuate face; and wherein the dipole magnet comprises neodymium, iron and boron.

18. The merchandise system as defined in claim 14, wherein the upper rod is shorter than the lower rod and the hooked end is permanently retained within the second passageway for sliding movement on the upper rod.

* * * * *